US011108141B2

(12) United States Patent
Furlan

(10) Patent No.: US 11,108,141 B2
(45) Date of Patent: Aug. 31, 2021

(54) EMBEDDED PATCH ANTENNAS, SYSTEMS AND METHODS

(71) Applicant: Taoglas Group Holdings Limited, San Diego, CA (US)

(72) Inventor: Vladimir Furlan, Munich (DE)

(73) Assignee: TAOGLAS GROUP HOLDINGS LIMITED, Enniscorthy (IE)

( * ) Notice: Subject to any disclaimer, the term of this patent is extended or adjusted under 35 U.S.C. 154(b) by 0 days.

(21) Appl. No.: 16/569,392

(22) Filed: Sep. 12, 2019

(65) Prior Publication Data

US 2020/0176859 A1 Jun. 4, 2020

Related U.S. Application Data

(60) Provisional application No. 62/730,268, filed on Sep. 12, 2018.

(51) Int. Cl.

| | |
|---|---|
| ***H01Q 1/32*** | (2006.01) |
| ***H01Q 21/00*** | (2006.01) |
| ***H01Q 9/04*** | (2006.01) |
| ***H01Q 1/12*** | (2006.01) |

(52) U.S. Cl.

CPC ..... *H01Q 1/3291* (2013.01); *H01Q 1/1271* (2013.01); *H01Q 9/0407* (2013.01); *H01Q 21/0068* (2013.01)

(58) Field of Classification Search

CPC ..... H01Q 1/32; H01Q 1/325; H01Q 1/3291; H01Q 1/1271; H01Q 9/0407; H01Q 21/0068

See application file for complete search history.

(56) References Cited

U.S. PATENT DOCUMENTS

| | | | |
|---|---|---|---|
| 4,870,375 | A | 9/1989 | Krueger, Jr. et al. |
| 6,677,909 | B2 | 1/2004 | Sun et al. |
| 6,963,312 | B2 | 11/2005 | Schunennan et al. |
| 7,271,779 | B2 | 9/2007 | Hertel |
| 8,362,958 | B2 | 1/2013 | Lin et al. |
| 8,427,373 | B2 | 4/2013 | Jiang et al. |

(Continued)

FOREIGN PATENT DOCUMENTS

| | | | | |
|---|---|---|---|---|
| CN | 202662795 U | * | 1/2013 | ..... H01Q 1/38 |
| KR | 101209620 | | 12/2012 | |

(Continued)

OTHER PUBLICATIONS

Mudegaonkar, et al. "A microstrip-line-fed suspended square slot microstrip antenna for circular polarization operations," Communications on Applied Electronics 1(3), Feb. 2015.

*Primary Examiner* — Hoang V Nguyen
(74) *Attorney, Agent, or Firm* — Garson & Gutierrez, PC

(57) ABSTRACT

Disclosed are patch antennas, systems and methods for embedding a patch antenna between two layers, such as two layers of glass. The glass layers may be a vehicle windshield. An embedded portion of an antenna substrate supporting the patch antenna may be embedded between the two layers, and an exposed portion of the antenna substrate may extend outward from the two layers. The embedded portion of the antenna substrate may support the patch antenna, and the exposed portion of the antenna substrate may support a coplanar waveguide and a connector.

19 Claims, 10 Drawing Sheets

(56) References Cited

U.S. PATENT DOCUMENTS

| | | | | |
|---|---|---|---|---|
| 8,810,462 | B2 * | 8/2014 | Goldberger | H01Q 1/1271 343/713 |
| 9,166,300 | B2 | 8/2015 | Taura | |
| 9,257,747 | B2 | 2/2016 | Flores-Cuadras | |
| 9,391,372 | B2 | 7/2016 | Hwang et al. | |
| 9,472,855 | B2 | 8/2016 | Toyao et al. | |
| 9,653,807 | B2 | 5/2017 | Binzer et al. | |
| 9,660,350 | B2 | 5/2017 | Lo Hine Tong et al. | |
| 10,910,692 | B2 | 2/2021 | Furlan | |
| 2005/0200557 | A1 | 9/2005 | Tanaka et al. | |
| 2010/0134376 | A1 * | 6/2010 | Margomenos | H01P 5/028 343/848 |
| 2011/0221652 | A1 | 9/2011 | Li et al. | |
| 2012/0068896 | A1 | 3/2012 | White et al. | |
| 2012/0127050 | A1 | 5/2012 | Song et al. | |
| 2013/0099981 | A1 | 4/2013 | Vortmeier et al. | |
| 2013/0257664 | A1 | 10/2013 | Kagaya et al. | |
| 2013/0321212 | A1 | 12/2013 | O'Shea et al. | |
| 2014/0060921 | A1 | 3/2014 | Reul et al. | |
| 2014/0111393 | A1 | 4/2014 | Lo Hine Tong et al. | |
| 2015/0091763 | A1 | 4/2015 | Lo Hine Tong et al. | |
| 2015/0364823 | A1 | 12/2015 | Hashimoto et al. | |
| 2016/0134021 | A1 | 5/2016 | Helander et al. | |
| 2017/0279177 | A1 | 9/2017 | Oguri et al. | |
| 2018/0037006 | A1 * | 2/2018 | Droste | H01Q 9/0428 |
| 2018/0191071 | A1 * | 7/2018 | Ndip | H01Q 9/30 |

FOREIGN PATENT DOCUMENTS

| | | |
|---|---|---|
| WO | 2012079029 | 6/2012 |
| WO | 2016141177 | 9/2016 |

* cited by examiner

EMBEDDED PATCH ANTENNAS, SYSTEMS AND METHODS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57. This application claims the benefit of priority under 35 U.S.C. § 119(e) of U.S. Provisional Application No. 62/730,268, entitled EMBEDDED PATCH ANTENNAS, SYSTEMS AND METHODS and filed on Sep. 12, 2018, the disclosure of which is hereby incorporated by reference in its entirety BACKGROUND

TECHNICAL FIELD

This application relates to patch antennas, particularly to patch antennas that can be integrated in vehicle windows.

DESCRIPTION OF RELATED TECHNOLOGY

The wireless communication industry continues to grow at increased rates and has been integrated into cars and other transportation. The need for smaller, inconspicuous and more powerful antennas for cars has increased substantially. A typical position for an antenna on the car is a "shark fin" located on the back of the car, either on the roof or the trunk. The use of a shark fin antenna is a good solution from an electrical point of view but is very visible and car designers do not like it.

A possible position where the antenna would not be visible at all would be if the antenna were positioned in a window of the vehicle, such as the windshield. This approach has only been used for AM and FM systems, due to the inability to integrate a connector such as a 50 Ohm RF connector between glass layers.

SUMMARY

The embodiments described herein each have several innovative aspects, no single one of which is solely responsible for the desirable attributes disclosed herein.

In one aspect, an antenna system is provided, including a first layer having an inner surface and an outer surface, and a second layer having an inner surface and an outer surface, the second layer inner surface facing the first layer inner surface. An antenna substrate may include, for example, a substrate having a first section and a second section, the first section of the substrate positioned between the first layer and the second layer, a patch antenna positioned on the first section of the substrate, a coplanar waveguide positioned on the second section of the substrate, a microstrip in electrical communication with the patch antenna at a first end and the coplanar waveguide at a second end, and a connector. An antenna ground plane may also be included.

The system may additionally include an intermediate layer. The intermediate layer may be positioned adjacent the first layer inner surface. The intermediate layer may be positioned adjacent the second layer inner surface. The antenna ground plane may be positioned on the outer surface of the second layer.

The coplanar waveguide may include a signal line extending between a first top ground plane and a second top ground plane. The signal line may be in contact with the microstrip at an edge of at least one of the first layer and the second layer. The antenna system of claim 8, where at least one of the first top ground plane and the second ground plane has an edge that is perpendicular to the at least one of a first layer edge and a second layer edge. The coplanar waveguide may additionally include a bottom waveguide ground plane located on the opposite side of the substrate from the first and second top ground planes and in electrical communication with at least one of the first and second top ground planes through a plurality of vias extending through the substrate.

The connector may be soldered to an exposed area of the second section of the antenna substrate in line with the coplanar waveguide.

In another aspect, a patch antenna is provided, including a substrate having a first section and a second section, the first section of the substrate configured to be positioned between two layers of material. a patch antenna positioned on the first section of the substrate. a coplanar waveguide positioned on the second section of the substrate. a conductive strip in electrical communication with the patch antenna at a first end and the coplanar waveguide at a second end. and a connector.

The coplanar waveguide can include a signal line extending between a first top ground plane and a second top ground plane. The coplanar waveguide can additionally include a bottom waveguide ground plane located on the opposite side of the substrate from the first and second top ground planes and in electrical communication with at least one of the first and second top ground planes through a plurality of vias extending through the substrate.

The connector can be soldered to the second section of the substrate area in line with the coplanar waveguide.

In another aspect, a multilayer glass structure with an integrated patch antenna is provided, the multilayer glass structure including: a first glass layer having an inner surface and an outer surface. a second layer having an inner surface and an outer surface, the inner surfaces of the first and second layers facing one another. an antenna substrate having a first section installed between the first glass layer and the second glass layer and a second section extending beyond an edge of at least one of the first or second glass layers. a patch antenna formed on the first section of the antenna substrate, the patch antenna located between the first glass layer and the antenna substrate. a coplanar waveguide formed on the second section of the antenna substrate, a conductive strip extending between the patch antenna and the coplanar waveguide, a connector located on the second section of the antenna substrate. and an antenna ground plane formed on the outer surface of the second glass layer.

The multilayer glass structure can be a vehicle windshield. The antenna ground plane can be substantially the same size and shape as the first section of the antenna ground plane. The multilayer glass can additionally include an intermediate layer located between the antenna substrate and at least one of the first or second glass layers.

The coplanar waveguide can include a signal line extending between a first top ground plane and a second top ground plane. The coplanar waveguide can additionally include a bottom waveguide ground plane located on the opposite side of the antenna substrate from the first and second top ground planes and in electrical communication with at least one of the first and second top ground planes through a plurality of vias extending through the substrate Another aspect of the disclosure is directed to antenna systems. Suitable antenna systems comprise: a first layer having an inner surface and an outer surface; a second layer having an inner surf ace and an outer surface, wherein the second layer inner surface faces the first layer inner surface; a patch antenna comprising a substrate having a first section and a second section wherein the first section of the substrate is positioned between the first layer and the second layer, a patch antenna positioned on the first section of the substrate, a coplanar waveguide positioned on the second section of the substrate, a microstrip in electrical communication with the first antenna at a first end and the coplanar waveguide at a second end, a ground plane, and a connector. Additionally, the antenna system can be further configurable to comprise an intermediate layer which can be positioned between the first layer and the second layer. The ground plane of the antenna can be positioned on the second layer. The ground plane can be selected from a first top ground plane, a second top ground plane and a bottom ground plane. The ground plane of the antenna can be positioned on the outer surface of the second layer. As will be appreciated by those skilled in the art, the patch antenna can have a two-dimensional shape selected from circular, triangular, trapezoidal, square and rectangular. Where the antenna system has a first top ground plane and a second top ground plane, the first top ground plane and the second top ground plane are in contact with the microstrip at an edge of at least one of the first layer and the second layer. Additionally, at least one of the first top ground plane and the second ground plane can have an edge that is perpendicular to the at least one of a first layer edge and a second layer edge. At least one of the first top ground plane and the second top ground plane can be positioned on the upper side and the underside of an exposed substrate area. Additionally, the coplanar waveguide can have a variety of shapes in a plane including straight and curved (e.g., s-shaped). The connector is soldered to an exposed substrate area in line with the coplanar waveguide. The connector can be a 50 Ohm RF connector, a 75 Ohm RF connector, or any other suitable connector.

Another aspect of the disclosure is directed to patch antennas configurable to install between two or more layers of material. Suitable patch antennas comprise: a substrate having a first section and a second section; a patch antenna positioned on the first section of the substrate wherein the first section of the substrate is positionable between two layers of material; a ground plane positioned on a second section of the substrate; a coplanar waveguide; a microstrip in electrical communication with the patch antenna at a first end and the ground plane at a second end; and a connector. The patch antenna can have any suitable two-dimensional shape including, but not limited to, circular, triangular, trapezoidal, square and rectangular. The ground plane can have an edge that is parallel to an edge of the substrate. A bottom ground plane can also be provided. The coplanar waveguide can be positioned on the upper side of the second section of the substrate. Additionally, the connector can be soldered to the second section of the substrate area in line with the coplanar waveguide.

Still another aspect of the disclosure is directed to methods of using an antenna. Suitable methods comprise the steps of: providing a patch antenna having a substrate, a first antenna positioned on first section of the substrate, a coplanar waveguide positioned on a second section of the substrate, a microstrip in electrical communication with the first antenna at a first end and the coplanar waveguide and a ground plane, and a connector, positioning the patch antenna between a first layer and a second layer; and connecting the patch antenna to remote electronics via the connector. Additionally, the patch antenna can be positioned adjacent an intermediate layer. Once installed, the patch antennas of the disclosure can operate, for example, at a peak gain of 2.3 dBi. The installed patch antennas can also be operated within a target frequency including, for example, a range of frequencies between 1.25-1.75 GHz.

Another aspect of the disclosure is directed to antenna systems. Suitable antenna systems comprise: a first layer having an inner surface and an outer surface; a second layer having an inner surf ace and an outer surf ace, wherein the second layer inner surface faces the first layer inner surface; a patch antenna means comprising a substrate having a first section and a second section wherein the first section of the substrate is positioned between the first layer and the second layer, a patch antenna means positioned on the first section of the substrate, a coplanar waveguide means positioned on the second section of the substrate, a microstrip means in electrical communication with the first antenna at a first end and the coplanar waveguide means at a second end, a ground plane means, and a connector means. Additionally, the antenna system can be further configurable to comprise an intermediate layer which can be positioned between the first layer and the second layer. The ground plane means of the antenna can be positioned on the second layer. The ground plane means can be selected from a first top ground plane means, a second top ground plane means and a bottom ground plane means. The ground plane means of the antenna can be positioned on the outer surface of the second layer. As will be appreciated by those skilled in the art, the patch antenna means can have a two-dimensional shape selected from circular, triangular, trapezoidal, square and rectangular. Where the antenna system has a first top ground plane means and a second top ground plane means, the first top ground plane means and the second top ground plane means are in contact with the microstrip means at an edge of at least one of the first layer and the second layer. Additionally, at least one of the first top ground plane means and the second ground plane means can have an edge that is perpendicular to the at least one of a first layer edge and a second layer edge. At least one of the first top ground plane means and the second top ground plane means can be positioned on the upper side and the underside of an exposed substrate area. Additionally, the coplanar waveguide means can have a variety of shapes in a plane including straight and curved (e.g., s-shaped). The connector means is soldered to an exposed substrate area in line with the coplanar waveguide means. The connector means can be a 50 Ohm RF connector means, a 75 Ohm RF connector means, or any other suitable connector means.

Yet aspect of the disclosure is directed to patch antenna means configurable to install between two or more layers of material. Suitable patch antenna means comprise: a substrate having a first section and a second section; a patch antenna means positioned on the first section of the substrate wherein the first section of the substrate is positionable between two layers of material; a ground plane means positioned on a second section of the substrate; a coplanar waveguide means; a microstrip means in electrical communication with the patch antenna means at a first end and the ground plane means at a second end; and a connector means. The patch antenna means can have any suitable two-dimensional shape including, but not limited to, circular, triangular, trapezoidal, square and rectangular. The ground plane means can have an edge that is parallel to an edge of the substrate. A bottom ground plane means can also be provided. The coplanar waveguide means can be positioned on the upper side of the second section of the substrate. Additionally, the connector means can be soldered to the second section of the substrate area in line with the coplanar waveguide means Still another aspect of the disclosure is directed to methods of using an antenna. Suitable methods comprise the steps of: providing a patch antenna means having a substrate, a first antenna positioned on first section of the substrate, a coplanar waveguide means positioned on a second section of the substrate, a microstrip means in electrical communication with the first antenna at a first end and the coplanar waveguide means and a ground plane means, and a connector means, positioning the patch antenna means between a first layer and a second layer; and connecting the patch antenna means to remote electronics via the connector means. Additionally, the patch antenna means can be positioned adjacent an intermediate layer. Once installed, the patch antenna means of the disclosure can operate, for example, at a peak gain of 2.3 dBi. The installed patch antenna means can also be operated within a target frequency including, for example, a range of frequencies between 1.25-1.75 GHz.

BRIEF DESCRIPTION OF THE DRAWINGS

The following is a brief description of each of the drawings, in which like reference numerals and designations indicate like elements.

DETAILED DESCRIPTION

Embodiments described herein are directed to antennas, systems and methods. An antenna, such as a patch antenna, is integratable between two layers, such as two layers of glass in a vehicle windscreen. The patch antenna may have a top side printed on a substrate, such as a flexible PCB, and a ground plane positioned on the inner surface of the glass, such as inside the car, attached to a suitable connector.

The antenna signal is fed through a connector to a coplanar waveguide (CPW). The connector may be a 50 Ohm RF connector, or a 75 Ohm RF connector. The coplanar waveguide may be connected to a microstrip line which feeds the antenna. A ground plane of the antenna may be printed on the bottom side of the glass inside the vehicle. Such an antenna can be integrated between two layers of glass in a windscreen of a vehicle, without requiring any modification of the vehicle body, and may be and is invisible, or substantially invisible, from an exterior of the vehicle.

Figure 1A:
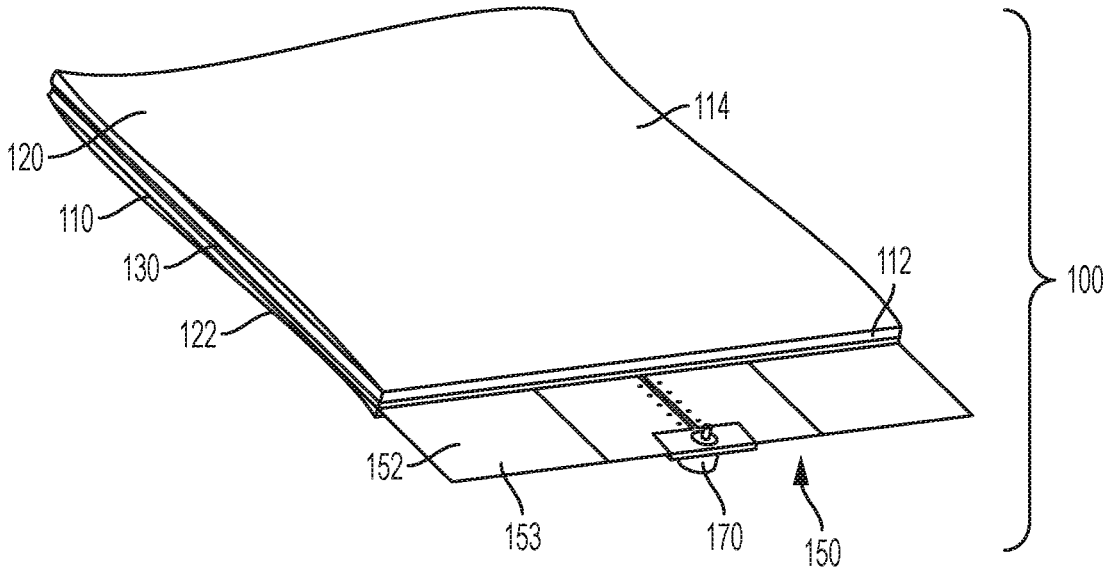
FIG. 1A is a top perspective view of an integrated antenna having a connector, the integrated antenna embedded between two layers.
Figure 1B:
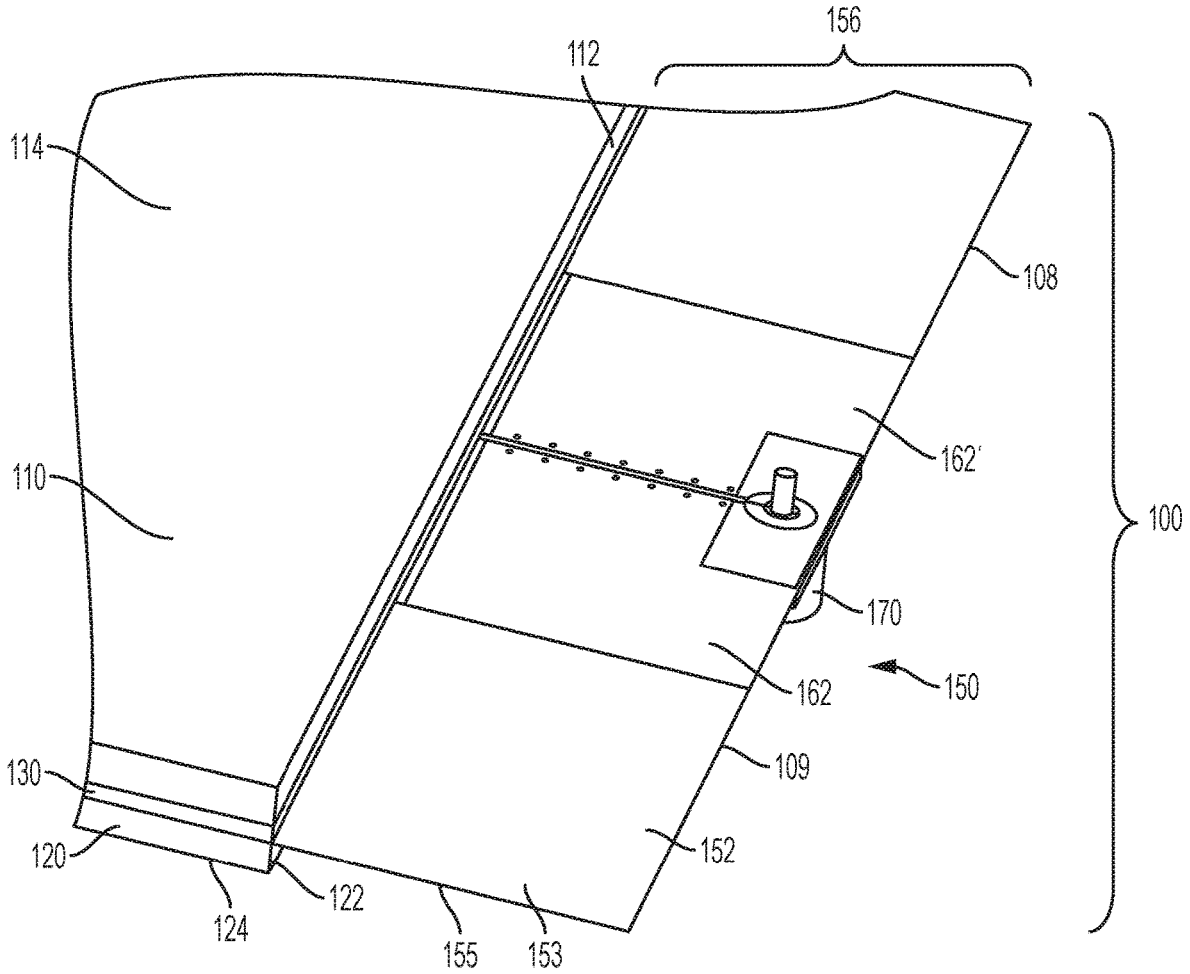
FIG. 1B is a top perspective view of the integrated antenna of FIG. 1A, showing a detailed view of a portion of a side of the integrated antenna adjacent the connector.

FIGS. 1A and 1B are isometric illustrations of an embodiment of an installed antenna system 100. The antenna system 100 is installed between two layers of material 110 and 120 and viewed from above an upper surface 114 of the layer 110. As illustrated in FIG. 1A, the installed antenna system 100 has an antenna 150 positioned between a first layer 110 and a second layer 120. An intermediate layer 130, such as a plastic foil layer, can be provided between the first layer 110 and the second layer 120. The first layer 110 and the second layer 120 are illustrated as a partial representation of the installation environment. When the antenna 150 is installed in, for example, a vehicle windshield, the overall dimension of the first layer 110 and the second layer 120 may be greater than the illustration in FIG. 1A, as the windshield may extend significantly beyond the dimensions of the antenna 150

Suitable antennas include a patch antenna or a low profile radio antenna. The material for the layers 110 and 120 can be a transparent material, substantially transparent material, or partially transparent material, such as glass or tinted glass. The layer 120 may correspond to the outer layer of a window or windshield of a car or other vehicle. Additionally, for example, in some embodiments the material of layers 110 and 120 can have transparent sections and opaque sections. The layers can be planar, with each layer positioned within parallel planes as depicted, but in other embodiments may be substantially planar or curved, such as a vehicle windshield.

The antenna 150, when installed between layers 110 and 120, has a first section (see section 154 of FIG. 2A) positioned between the first layer 110 and the second layer 120, and a second section (see section 156 of FIG. 2A) extending outward beyond the edges of the first layer 110 and the second layer 120, and not located between the first layer 110 and the second layer 120.

The first layer 110 has a first layer edge 112, which in the illustrated embodiment is shown as being perpendicular to an upper surface 114 of the first layer 110. The second layer 120 has a second layer edge 122, which in the illustrated embodiment is shown as being perpendicular to a lower surface 124 of the second layer 120. In the context of a vehicle windshield, for example, the upper surface 114 can be an exterior facing surface, and the lower surface 124 can be an interior facing surface facing into the interior of the vehicle.

FIG. 1B is a detailed view illustrating certain components of installed antenna system 100 in more detail. The antenna 150 includes a substrate 152, such as a printed circuit board (PCB), where one portion of the substrate 152 is embedded between the first layer 110 and a second layer 120 and another portion of the substrate 152 extends outward beyond the first layer edge 112 of the first layer 110. The substrate 152 can be a flexible substrate, such as a flexible PCB.

The first layer edge 112 of the first layer 110 and the second layer edge 122 of the second layer 120 in the illustrated embodiment are flush with one another, in addition to being parallel to one another and orthogonal to the planes of the first layer 110 and second layer 120. In other embodiments, however, the first layer edge 112 is not orthogonal to the upper surface 114 of the first layer 110 and/or the second layer edge 122 is not orthogonal to the lower surface 124 of the second layer 120. In other embodiments, the edges may have different shapes, as discussed in greater detail below.

In the illustrated embodiment, the substrate 152 is shown substantially rectangular with a total length L and a total width W in a first planar dimension. In other embodiments, however, other shapes can be employed without departing from the scope of the disclosure. In some embodiments, the total width W can be from about 45 mm to about 110 mm, and in some particular embodiments may be about 80 mm, although widths outside of this range may also be used. In some embodiments, the total length L can be from about 50 mm to about 100 mm, and in some particular embodiments may be about 75 mm. As will be appreciated by those skilled in the art, the overall length and width can change depending on the design of the antenna without departing from the scope of the disclosure.

As can be seen in FIG. 1B, a portion of the substrate 152 is positioned between the first layer 110 and the second layer 120. Intermediate layer 130, which is also positioned between the first layer 110 and the second layer 120, is in the illustrated embodiment positioned on an upper surface 153 of the substrate 152 and covered by the first layer 110. The second layer 120 is in contact with the bottom surface 155 of the substrate 152. In one embodiment, about 75% of the area of substrate 152 is positioned between the two layers 110 and 120, and the other 25% of the substrate 152 extends beyond the edge of the two layers 110 and 120. In other embodiments, larger or smaller amounts of the area of substrate 152 may be located between the two layers 110 and 120.

A substrate bottom edge including bottom edge sections 108, 109 of the substrate 152 is not embedded between the layers 110 and 120. The bottom edge sections 108, 109 in the illustrated embodiment extend parallel to, the first layer edge 112 of the first layer 110. The bottom edge sections 108, 109 of the substrate bottom edge defines the length L of the substrate 152. The bottom edge includes the width of the first top ground plane 162 and the second top ground plane 162'.

The substrate 152 includes an exposed second section 156 of the substrate 152 that is not embedded between the first layer 110 and the second layer 120. The second section 156 of the substrate 152 includes a first top ground plane 162 and a second top ground plane 162'. In the illustrated embodiment first top ground plane 162 and the second top ground plane 162' are depicted as substantially rectangular in shape. However, in other embodiments, the first top ground plane 162 and the second top ground plane 162' can also have other shapes without departing from the scope of the disclosure. Suitable additional shapes for the first top ground plane 162 and the second top ground plane 162' include, for example, square, rectangular, oval, ovoid, round, hexagonal, and triangular, as well as any other suitable shapes.

The first top ground plane 162 and the second top ground plane 162' are positioned adjacent to the first layer edge 112. In the illustrated embodiment, the first top ground plane 162 and the second top ground plane 162' extend entire width of the exposed portion 156 of the substrate 152 from the first layer edge 112 to the substrate bottom edge section 108. In some embodiments, the first top ground plane 162 and the second top ground plane 162' can each have an edge that is parallel to and coincident with the respective substrate bottom edge sections 108, 109. In other configurations, the edge of the first top ground plane 162 and the second top ground plane 162' can be recessed from the substrate bottom edge sections 108, 109. As will be appreciated by those skilled in the art, the substrate bottom edge sections 108, 109 do not need to be straight and/or parallel to the edge of the substrate. Additionally, the first top ground plane 162 and the second top ground plane 162' do not have to run all the way to the bottom edge sections 108 and 109. The flexible substrate can be longer without departing from the scope of the disclosure.

The first top ground plane 162 and the second top ground plane b are soldered or otherwise connected to a connector 170. In some embodiments, the connector 170 may be a 50 Ohm RF connector, a 75 Ohm RF connector, or any other suitable connector. The connector 170 may be located at the bottom edge of the substrate 152 and may be positioned as shown, roughly in the center of the substrate 152 between the first top ground plane 162 and the second top ground plane 162'. In other embodiments, the connector 170 may be positioned in another location without departing from the scope of the disclosure. The connector 170 includes a power plug for a connecting cable (not shown). The power plug and cable can be used to connect the antenna to electronics located inside the vehicle.

Figure 2A:
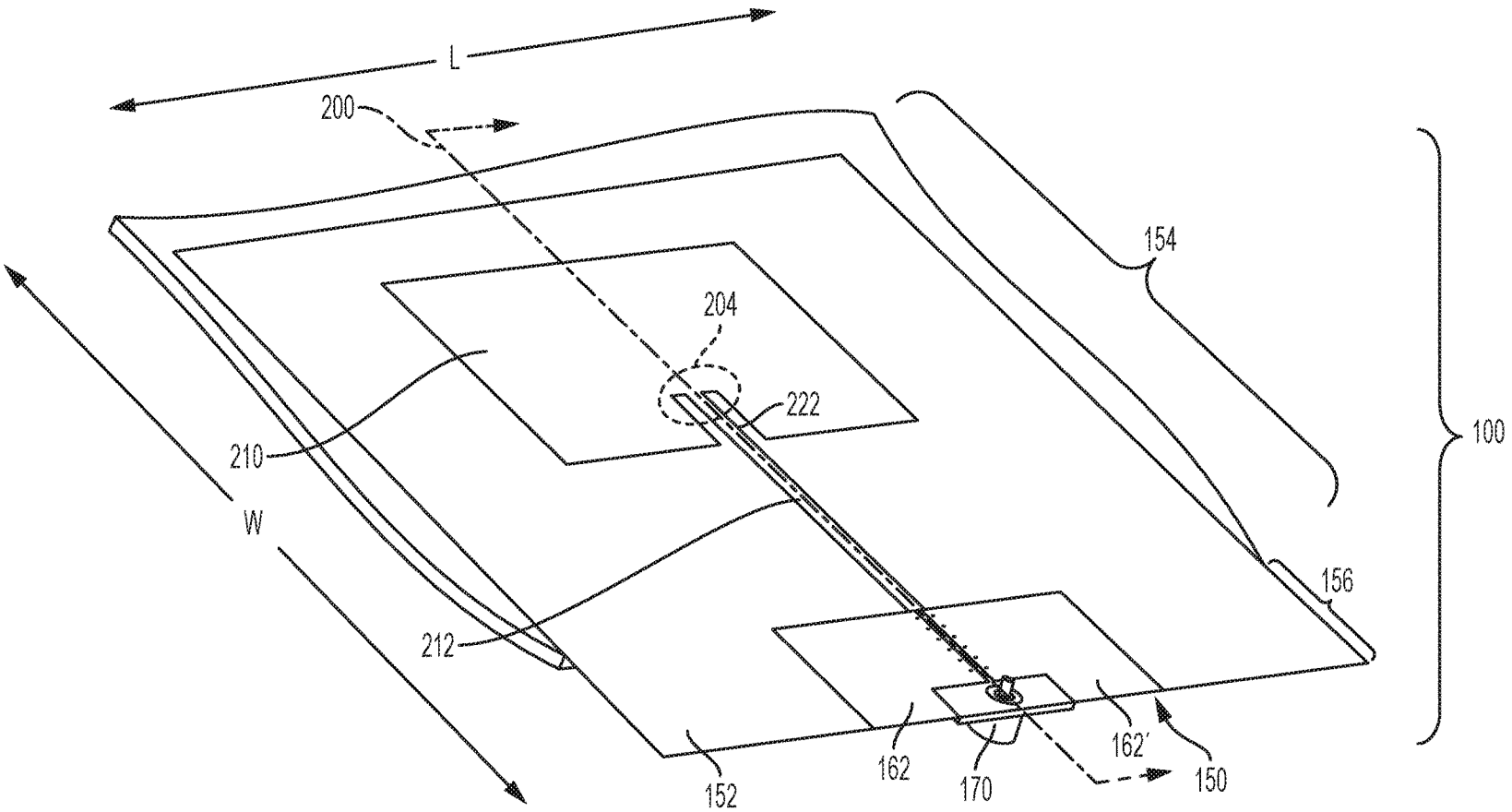
FIG. 2A is a top perspective view of a patch antenna, shown without a layer above the patch antenna to illustrate a coplanar waveguide (CPW) transition to a microstrip.
Figure 2B:
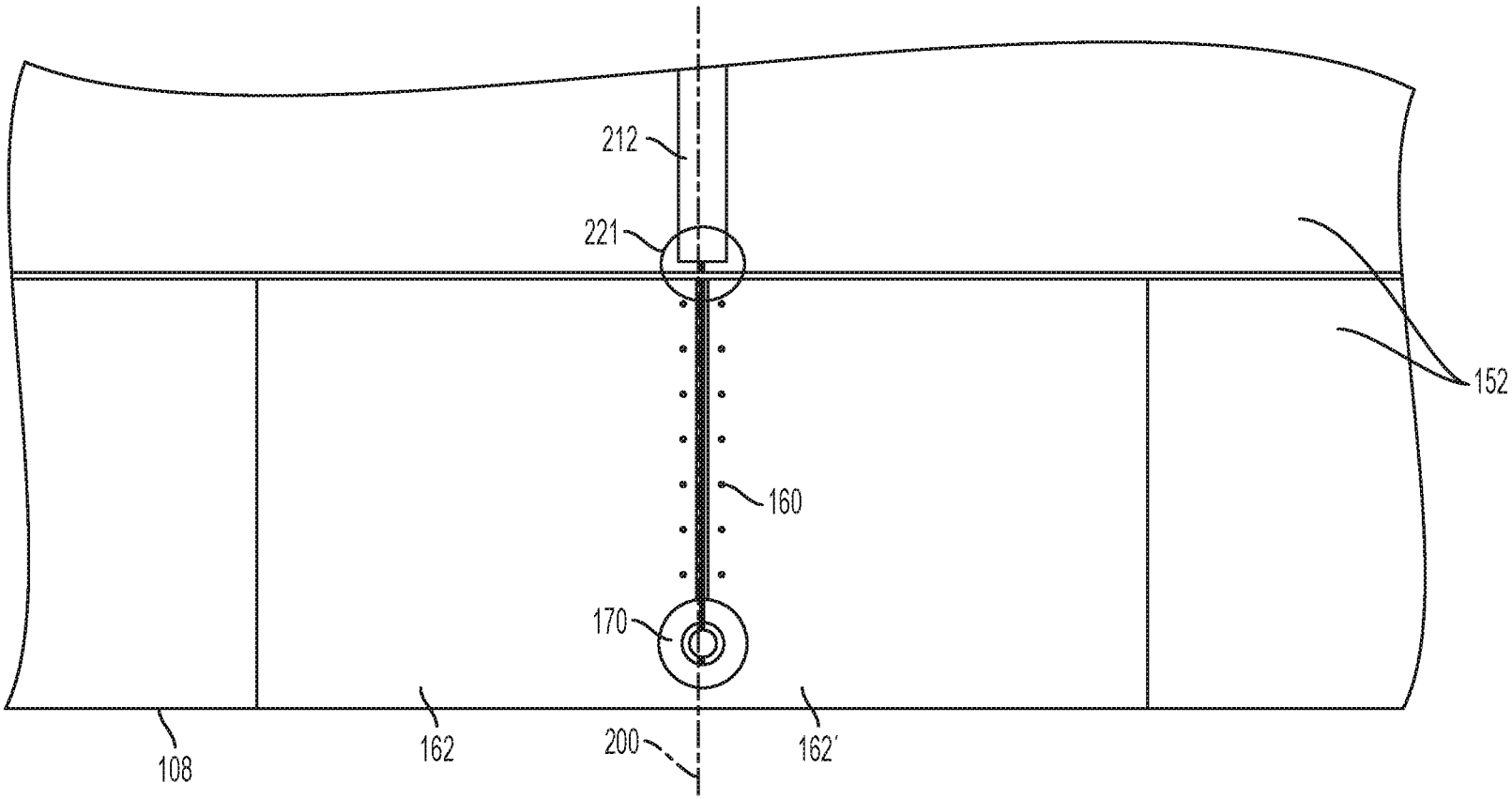
FIG. 2B is a top plan view of the integrated antenna of FIG. 2A, showing a detailed view of a portion of a side of the integrated antenna adjacent a connector.

FIGS. 2A and 2B are isometric illustrations of an installed antenna system 100 from above, with the first layer 110 and intermediate layer 130 shown in FIGS. 1A and 1B removed, so that the entire area of substrate 152 is visible in FIG. 2A. The substrate 152 includes an antenna 210 is shown on the substrate 152, as would be viewable from outside a vehicle, through the layer 110 of the windshield or window. The antenna 210 is illustrated as rectangular in shape. The antenna 210 has a width in the direction of the total width W of the substrate 152, and a length in the direction of the total length L of the substrate 152. In the illustrated embodiment, the antenna 210 is roughly centered on the substrate 152 and positioned on a centerline 200. The shape and overall length and width of the antenna 210 can change without departing from the scope of the disclosure, as well as the location on the substrate 152. The centerline 200 may in some embodiments be a centerline of the antenna 210 without necessarily being the centerline of the substrate 152.

Figure 2C:
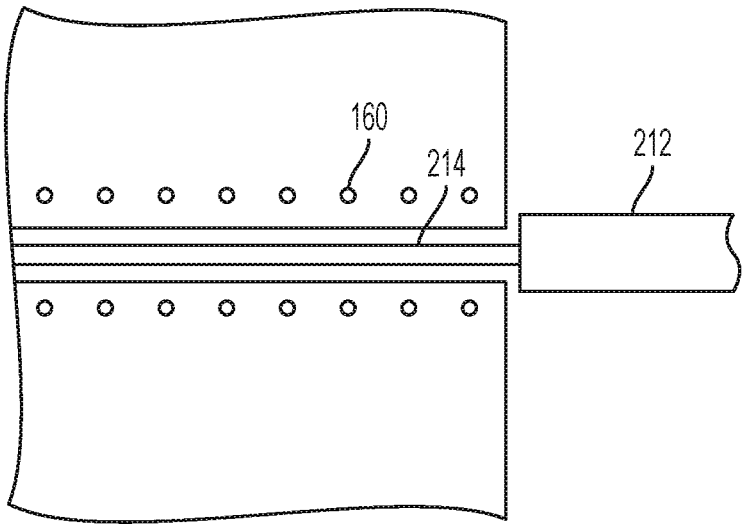
FIG. 2C is a detailed view of a CPW to microstrip transition such as that of the antenna of FIG. 2A.

The antenna 210 can connect to a microstrip 212 extending between the antenna 210 and the first top ground plane 162 and the second top ground plane 162'. The microstrip 212 may be connected to a signal line 214 of a coplanar waveguide (CPW) including the signal line extending between the first top ground plane 162 and the second top ground plane 162', as illustrated in FIG. 2C. The first top ground plane 162 and the second top ground plane 162' are in the illustrated embodiment also positioned about the centerline 200. The microstrip 212 can a thin elongated strip which in the illustrated embodiment is generally rectangular in shape. The microstrip 212 can be perpendicular to the substrate bottom edge 108 of the substrate 152 feeding the antenna 210 and in-line with the connector 170. The width of the microstrip 212 can be substantially less than the length of the microstrip 212.

As shown in more detail in FIG. 2B, a first transition 221 is made where the microstrip 212 and second top ground plane 162' meet. A second transition 222 is made, where the microstrip 212 and the antenna 210 meet. In the illustrated embodiment, the antenna 210 has a cutout 204 for the second transition 222. The cutout 204 is centered around the microstrip 212 and approximately 25% of the length of the microstrip 212 and three times the width of the microstrip 212. In the illustrated embodiment, the microstrip 212 is positioned part way inside the antenna cutout 204 with rectangular gaps on either side having a width of about the width of the microstrip. The antenna 210 and the microstrip 212 can be integrally formed either from a single piece of material or can be formed such that they operate as a single unit.

In the illustrated embodiment, antenna 210 is depicted as substantially square. However, other shapes including, for example, rectangular, circular, and triangular, can be employed without departing from the scope of the disclosure. As an example, in some embodiments, a suitable width for the antenna 210 can be from about 33 mm to about 39 mm and a suitable length for the antenna 210 from about 40 mm to about 56 mm in length. A suitable dimension for the microstrip 212 can be from about 1 mm to about 2 mm in width. As will be appreciated by those skilled in the art, the length of the microstrip 212 can vary depending on the installation requirements.

FIG. 2C illustrates a close-up of the transition 221 from the coplanar waveguide 214 to the microstrip 212. A plurality of vias 160 can be provided on the first top ground plane 162 and second top ground plane 162'. In some embodiments, these vias 160 can be used to connect the first and second top ground planes 162 and 162' to a ground plane underlying the substrate 152.

Figure 3A:
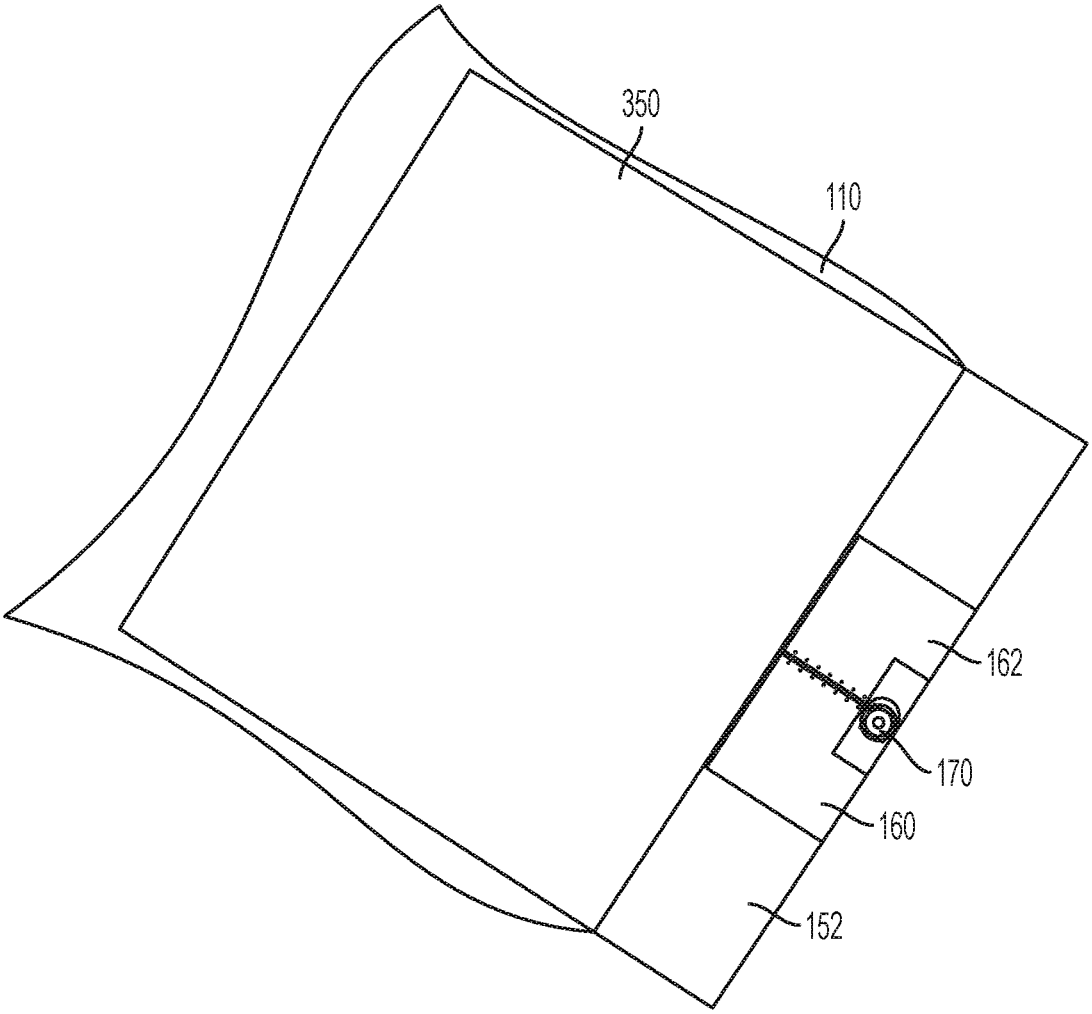
FIG. 3A is a bottom perspective view of a patch antenna in which a ground plan is printed on an intermediate layer.
Figure 3B:
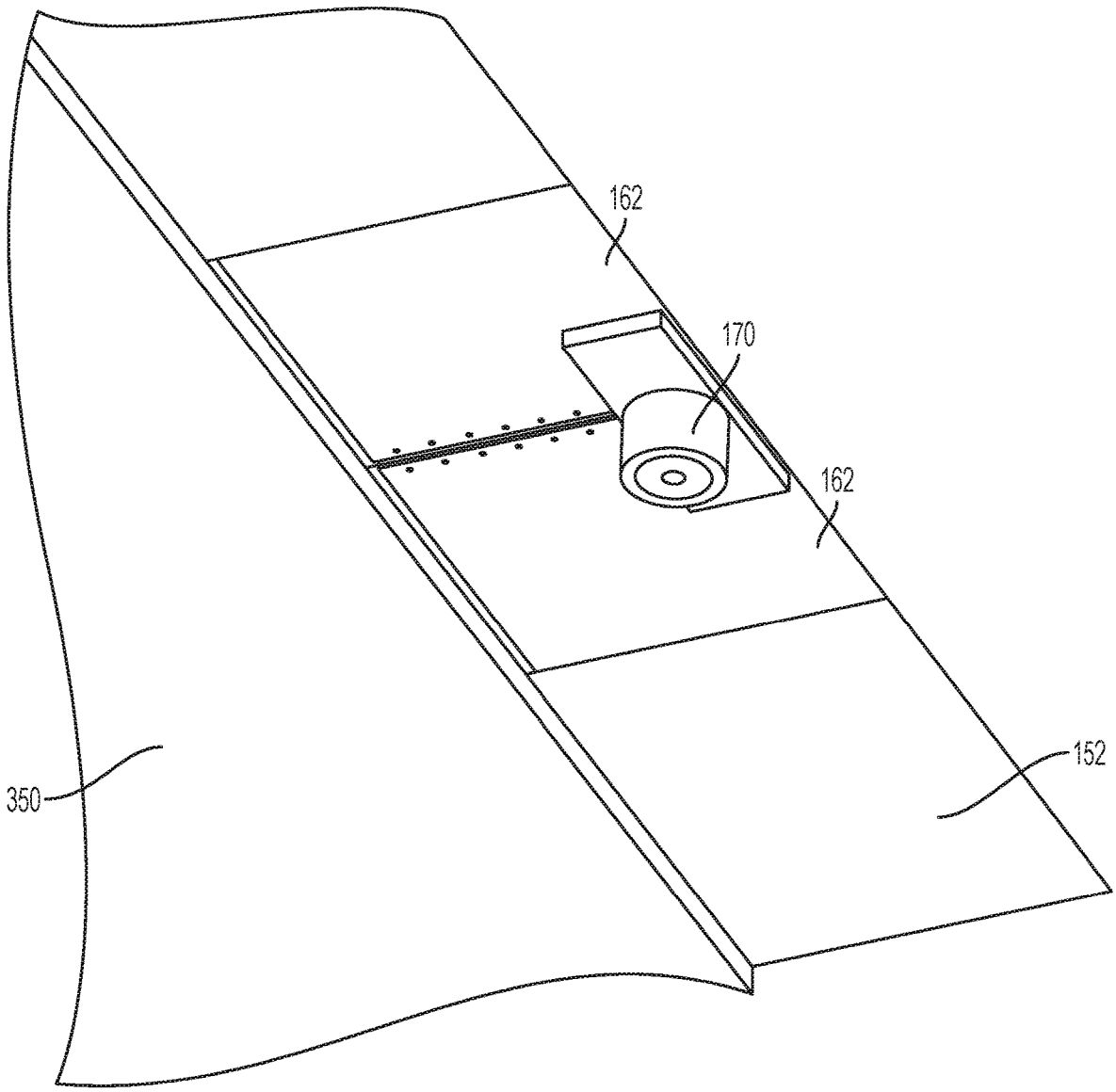
FIG. 3B is a bottom perspective view of the patch antenna of FIG. 3A, showing a detailed view of a portion of a side of the patch antenna adjacent a connector.

FIGS. 3A and 3B is an isometric illustration of the installed antenna system 100 from a lower surface, such as viewed from the inside of a vehicle. An antenna ground plane 350 of the antenna system 100 is printed on a second surface of the second layer 120 that is not in contact with the substrate 152. In the illustrated embodiment, the antenna ground plane 350 of the antenna system 100 is printed on the opposite side of the second layer 120 as the substrate 152.

The antenna ground plane 350 of the antenna system 100 can be substantially rectangular in shape. In some embodiments, the antenna ground plane 350 can occupy an area corresponding substantially to the portion of the substrate embedded in between the first layer 110 and the second layer 120, such as the first section 154 (see FIG. 2A) of the substrate 152. A first edge of the antenna ground plane 350 may be aligned with, for example, the first layer edge 112 of the first layer 110, shown in FIGS. 1A and 1B.

In addition to the antenna ground plane 350 of the antenna system, the antenna system can also include a waveguide bottom ground plane 352 which is connected by means of the vias 160 to the top ground planes 162 and 162' on either side of the signal line 214 of the coplanar waveguide. The waveguide bottom ground plane 352 is located on the underside of substrate 152 and may be similar in size and shape to the total area covered by the top ground planes 162 and 162' on the opposite side of substrate 152.

In another embodiment, the waveguide bottom ground plane 352 may be omitted from the coplanar waveguide configuration, and vias 160 may be omitted as well. In an embodiment without the waveguide bottom ground plane 352, the width of the first top ground plane 162 and second top ground plane 162' may be of a defined width to provide the coplanar waveguide.

Figure 4A:
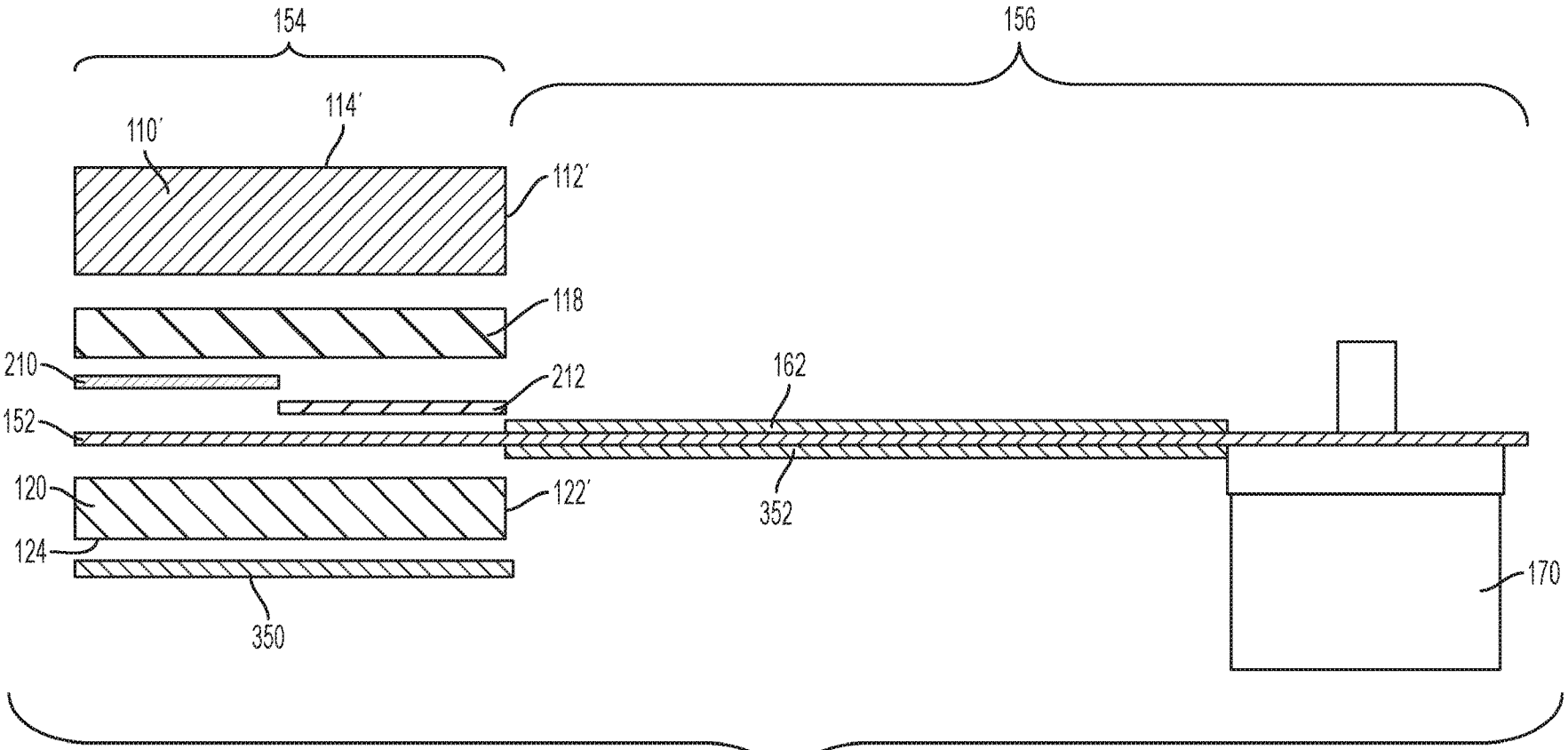
FIG. 4A is an exploded side cross-sectional view of an antenna assembly including an antenna positioned between two layers.

FIG. 4A is an exploded side cross-sectional view of an antenna assembly including an antenna positioned between two layers. The cross-sectional view is taken along a line similar to the centerline 200 shown in FIG. 2B. FIG. 4A illustrates the first layer 110, the second layer 120, the intermediate layer 130 and a relative position of the substrate 152 of the antenna 150 within the layers. Additionally, FIG. 4A shows the section of the substrate 152 that is positioned between the layers 110 and 120, such as between layers of glass, which contains the antenna 210 and the microstrip 212 printed on a surface of the substrate 152, located under the intermediate layer 130 and first layer 110. The bottom ground plane 350 of the antenna 302 is shown printed on the second layer 120 on the side of the second layer 120 opposite the substrate 152.

The exposed section of the substrate 152 supports the components of the coplanar waveguide, including the first top ground plane 162 and the wavelength bottom ground plane 352, as well as the signal line 214 and the second top ground plane 262' (not shown). A connector 170 is positioned at the edge of the substrate 152. As shown in FIG. 4A, the edge of the first layer 110 and the second layer 120 can be perpendicular to the surface of the layer as shown in FIG. 4A, but other shapes can also be used. In other embodiments, the edge can be beveled or chamfered so that the edge of the first layer and/or the edge of the second layer is not perpendicular to the surface of the first layer 110 and/or the second layer 120.

Figure 4B:
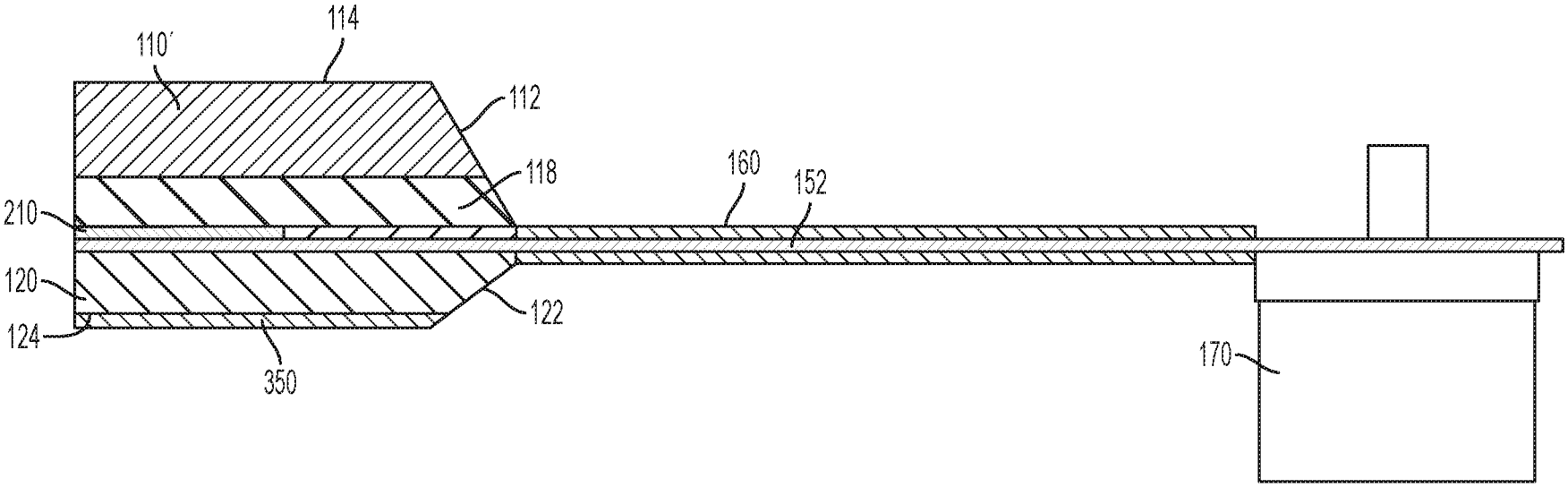
FIG. 4B is an assembled side cross-sectional view of another embodiment of an antenna assembly positioned between two layers, where the two layers have a different edge profile than the layers of FIG. 4A.

FIG. 4B is an assembled side cross-sectional view of another embodiment of an antenna assembly positioned between two layers, where the two layers have a different edge profile than the layers of FIG. 4A. FIG. 4B illustrates the edges at an angle to the exterior surfaces of the first layer 110 and the second layer 120

Figure 4C:
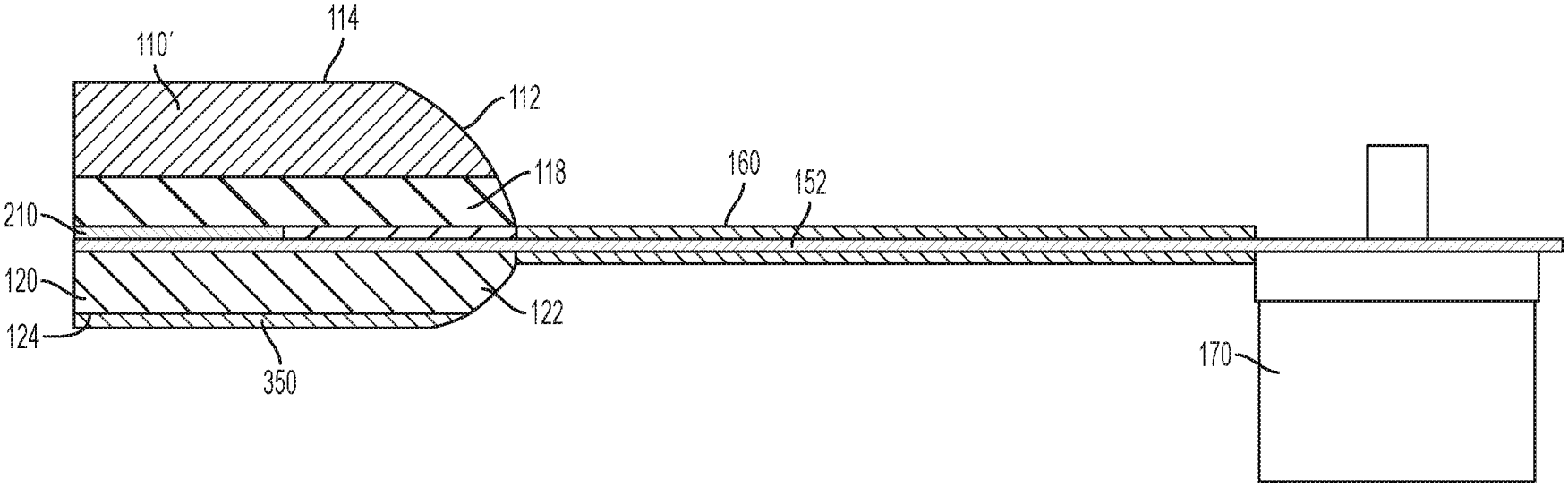
FIG. 4C is a side cross-sectional view of another embodiment of an antenna assembly positioned between two layers, where the two layers have a different edge profile than the layers of FIGS. 4A and 4B.

FIG. 4C is a side cross-sectional view of another embodiment of an antenna assembly positioned between two layers, where the two layers have a different edge profile than the layers of FIGS. 4A and 4B. FIG. 4C illustrates the edges as curved relative to the exterior surfaces of the first layer 110 and the second layer 120.

An antenna installed in a vehicle and facing outside the window can have a signal strength that increases perpendicularly away from the surface of the antenna from 0 dB to about 2.3 dB, and can have a return loss of −10 dB or better at a center frequency of 1.575 GHz. As will be appreciated by those skilled in the art, one or more patch antennas can be installed between two layers of material without departing from the scope of the disclosure.

Embodiments of antennas described herein may be installed in, for example, a vehicle windshield prior to installing the windshield in a vehicle. In use, the antenna, such as a patch antenna, may be positioned between a first layer and a second layer, such as a first layer and second layer of a windshield, and then connected to remote electronic located within the vehicle after the layers are installed. The installed antenna can be operated at a peak gain of, for example, 2.3 dBi and within a range of frequencies between 1.25 GHz and 1.75 GHz.

While certain embodiments of the present invention have been shown and described herein, it will be obvious to those skilled in the art that such embodiments are provided by way of example only. Numerous variations, changes, and substitutions will now occur to those skilled in the art without departing from the invention. It is intended that the following the claims are not intended to be limited to the embodiments shown herein, but are to be accorded the widest scope consistent with this disclosure, the principles and the novel features disclosed herein.

What is claimed is:

1. A multilayer glass structure with an integrated patch antenna, the multilayer glass structure comprising:

a first glass layer having an inner surface and an outer surface;

a second layer having an inner surface and an outer surface, the inner surfaces of the first and second layers facing one another;

an antenna substrate having a first section installed between the first glass layer and the second glass layer and a second section extending beyond an edge of at least one of the first or second glass layers;

a patch antenna formed on the first section of the antenna substrate, the patch antenna located between the first glass layer and the antenna substrate;

a coplanar waveguide formed on the second section of the antenna substrate, a conductive strip extending between the patch antenna and the coplanar waveguide, a connector located on the second section of the antenna substrate; and an antenna ground plane formed on the outer surface of the second glass layer.

2. The multilayer glass structure of claim 1, wherein the multilayer glass structure comprises a vehicle windshield.

3. The multilayer glass structure of claim 1, wherein the antenna ground plane is substantially the same size and shape as the first section of the antenna substrate.

4. The multilayer glass structure of claim 1, wherein the coplanar waveguide includes a signal line extending between a first top ground plane and a second top ground plane.

5. The multilayer glass structure of claim 4, wherein the coplanar waveguide additionally includes a bottom waveguide ground plane located on the opposite side of the antenna substrate from the first and second top ground planes and in electrical communication with at least one of the first and second top ground planes through a plurality of vias extending through the substrate.

6. The multilayer glass structure of claim 1 further comprising an intermediate layer located between the antenna substrate and at least one of the first or second glass layers.

7. An antenna system, comprising:

a first layer having an inner surface and an outer surface;

a second layer having an inner surface and an outer surface, the second layer inner surface facing the first layer inner surface;

an antenna substrate comprising:

a substrate having a first section and a second section, the first section of the substrate positioned between the first layer and the second layer, a patch antenna positioned on the first section of the substrate, a coplanar waveguide positioned on the second section of the substrate, a microstrip in electrical communication with the patch antenna at a first end and the coplanar waveguide at a second end, and a connector; and an antenna ground plane positioned on the outer surface of the second layer.

8. The antenna system of claim 7, further comprising an intermediate layer.

9. The antenna system of claim 8, wherein the intermediate layer is positioned adjacent the first layer inner surface.

10. The antenna system of claim 8, wherein the intermediate layer is positioned adjacent the second layer inner surface.

11. The antenna system of claim 7, wherein the coplanar waveguide includes a signal line extending between a first top ground plane and a second top ground plane.

12. The antenna system of claim 11, wherein the signal line is in contact with the microstrip at an edge of at least one of the first layer and the second layer.

13. The antenna system of claim 12, wherein at least one of the first top ground plane and the second top ground plane has an edge that is perpendicular to the at least one of a first layer edge and a second layer edge.

14. The antenna system of claim 13, wherein the coplanar waveguide additionally includes a bottom waveguide ground plane located on an opposite side of the substrate from the first and second top ground planes and in electrical communication with at least one of the first and second top ground planes through a plurality of vias extending through the substrate.

15. The antenna system of claim 7, wherein the connector is soldered to an exposed area of the second section of the substrate in line with the coplanar waveguide.

16. A patch antenna, comprising:

a substrate having a first section and a second section, the first section of the substrate configured to be positioned between two layers of material;

a patch antenna positioned on the first section of the substrate;

a coplanar waveguide positioned on the second section of the substrate;

a conductive strip in electrical communication with the patch antenna at a first end and the coplanar waveguide at a second end; and a connector;

wherein the coplanar waveguide includes a signal line extending between a first top ground plane and a second top ground plane and the signal line is in contact with the conductive strip at an edge of at least one of the two layers of material.

17. The patch antenna of claim 16, wherein the signal line of the coplanar waveguide extends between a first top ground plane and a second top ground plane.

18. The patch antenna of claim 17, wherein the coplanar waveguide additionally comprises a bottom waveguide ground plane located on an opposite side of the substrate from the first and second top ground planes and in electrical communication with at least one of the first and second top ground planes through a plurality of vias extending through the substrate.

19. The patch antenna of claim 16, wherein the connector is soldered to the second section of the substrate area in line with the coplanar waveguide.

* * * * *